United States Patent [19]

Stauffacher

[11] Patent Number: 4,688,467

[45] Date of Patent: Aug. 25, 1987

[54] APPARATUS FOR INSERTING A CARTRIDGE INTO THE CARTRIDGE CHAMBER OF A WEAPON BARREL

[75] Inventor: Werner Stauffacher, Effretikon, Switzerland

[73] Assignee: Werkzeugmaschinenfabrik Oerlikon-Bührle AG, Zurich, Switzerland

[21] Appl. No.: 932,627

[22] Filed: Nov. 20, 1986

Related U.S. Application Data

[63] Continuation-in-part of Ser. No. 636,616, Aug. 1, 1984, abandoned.

[30] Foreign Application Priority Data

Aug. 5, 1983 [CH] Switzerland ..... 4263/83

[51] Int. Cl.[4] ..... F41D 10/36

[52] U.S. Cl. ..... 89/33.2; 89/33.04

[58] Field of Search ..... 89/33.01, 33.04, 33.1, 89/33.14, 33.2

[56] References Cited

U.S. PATENT DOCUMENTS

| | | | |
|---|---|---|---|
| 1,005,263 | 10/1911 | McClean | 89/33.1 |
| 2,397,501 | 4/1946 | Meyer | 89/33.2 |
| 2,486,878 | 11/1949 | Rataiczak | 89/33.2 |
| 2,857,813 | 10/1958 | Elliott | 89/33.2 |
| 2,875,671 | 3/1959 | Robinson | 89/33.2 |
| 3,080,793 | 3/1963 | Montana | 89/33.01 |
| 3,630,118 | 12/1971 | Stoner | 89/33.2 |
| 3,680,432 | 8/1972 | Rocha | 89/33.04 |
| 3,955,469 | 5/1976 | Conley | 89/33.2 |
| 4,069,740 | 1/1978 | Hottinger et al. | 89/33.04 |
| 4,280,392 | 7/1981 | Hürlemann | 89/33.2 |

FOREIGN PATENT DOCUMENTS

| | | | |
|---|---|---|---|
| 87743 | 8/1959 | Denmark | 89/33.2 |
| 2271535 | 12/1975 | France . | |
| 555265 | 8/1943 | United Kingdom . | |

*Primary Examiner*—Stephen C. Bentley
*Attorney, Agent, or Firm*—Werner W. Kleeman

[57] ABSTRACT

The cartridges are delivered laterally adjacent to the weapon barrel by a cartridge feed mechanism and must be deflected or depressed upon insertion of the cartridges into a cartridge chamber of the weapon barrel by the breechblock. At high cadences there is the risk that the cartridges slide off from the breechblock and impinge with their tips against the weapon barrel and then cannot be inserted. The inventive apparatus is intended to avoid this risk. A pivotable supporting and deflecting pawl having a pivot axis parallel to the weapon axis ensures reliable insertion of the cartridges into the weapon barrel.

3 Claims, 2 Drawing Figures

APPARATUS FOR INSERTING A CARTRIDGE INTO THE CARTRIDGE CHAMBER OF A WEAPON BARREL

CROSS REFERENCE TO RELATED APPLICATION

This application is a continuation-in-part application of the cognate copending U.S. patent application Ser. No. 06/636,616, filed Aug. 1, 1984, now abandoned and entitled "APPARATUS FOR INSERTING A CARTRIDGE INTO THE CARTRIDGE CHAMBER OF A WEAPON BARREL".

BACKGROUND OF THE INVENTION

The present invention broadly relates to an apparatus for inserting or ramming cartridges into the weapon barrel of a firing weapon. More specifically, the present invention pertains to a new and improved construction of an apparatus for inserting or ramming cartridges into the cartridge chamber of the weapon barrel of an automatic firing weapon having a reciprocating bolt or breechblock which inserts or rams the cartridges from a cartridge feed or supply channel arranged adjacent to the weapon into the cartridge chamber of the weapon barrel. The apparatus contains guide means which depress or deflect the cartridge to be inserted from the cartridge feed channel toward the weapon barrel.

Generally speaking, the apparatus of the present invention for inserting or ramming cartridges into the cartridge chamber of the weapon barrel of an automatic firing weapon comprises a cartridge feed channel arranged adjacent to the weapon barrel, a reciprocating breechblock for inserting or ramming cartridges from the cartridge feed channel into the cartridge chamber of the weapon barrel, and guide means for deflecting or depressing cartridges in the cartridge feed channel toward the cartridge chamber of the weapon barrel.

Known apparatus of this type are described, for example, in the following U.S. Pat. Nos.:

1,005,263, granted Oct. 10, 1911
2,397,501, granted Apr. 2, 1946
2,486,878, granted Nov. 1, 1949
2,857,813, granted Oct. 28, 1958
2,875,671, granted Mar. 3, 1959
3,080,793, granted Mar. 12, 1963
3,630,118, granted Dec. 28, 1971
3,680,432, granted Aug. 1, 1972
3,955,469, granted May 11, 1976
4,069,740, granted Jan. 24, 1978
4,280,392, granted July 28, 1981 as well as in British Patent No. 555,265, granted Aug. 13, 1943, Danish Patent No. 87,743, published Nov. 16, 1959, and French Patent Publication No. 2,271,535, published Dec. 12, 1975.

All such known apparatuses contain resilient or spring-loaded guide elements for deflecting or depressing the cartridges present in the cartridge feed or supply channel toward the cartridge chamber during the time such cartridges are inserted from the cartridge feed or supply channel into the cartridge chamber. It has now been found that resilient or spring-loaded elements are unsuitable for such use because the resilient or spring-loaded elements are too weak to withstand the strong forces appearing during the insertion of cartridges from the cartridge feed or supply channel into the cartridge chamber of the weapon barrel.

SUMMARY OF THE INVENTION

Therefore, with the foregoing in mind it is a primary object of the present invention to provide a new and improved construction of an apparatus for inserting or ramming cartridges from a cartridge feed or supply channel into the cartridge chamber of a weapon barrel of an automatic firing weapon and which apparatus does not exhibit the aforementioned drawbacks and shortcomings of the prior art constructions.

Another and more specific object of the present invention aims at providing a new and improved construction of an apparatus of the previously mentioned type and which apparatus is of relative simple construction and requires no supplementary operating components.

A further important object of the present invention is directed to a new and improved construction of an apparatus for inserting or ramming cartridges from a cartridge feed or supply channel into the cartridge chamber of a weapon barrel of an automatic firing weapon and which apparatus is not subject to deflection against the force of a spring during the insertion or ramming of the cartridges under the action of the breechblock.

Yet a further significant object of the present invention aims at providing a new and improved construction of an apparatus of the character described which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the apparatus of the present development is manifested by the features that, a cartridge feed channel is arranged adjacent to the weapon barrel and a breechblock reciprocates within the weapon housing of the automatic firing weapon for inserting cartridges from the cartridge feed channel into the cartridge chamber of the weapon barrel. Guide means are provided for deflecting cartridges which are present in the cartridge feed channel, towards the weapon barrel and such guide means contain cartridge supporting and deflecting means protruding into the cartridge feed channel in the region of the cartridge tips of the cartridges and act upon the cartridge tips at the start of the insertion of the cartridges into the cartridge chamber. The cartridge supporting and deflecting means contain a guide surface which faces the cartridge arranged in the cartridge feed channel. Means are provided for pivotably mounting the cartridge supporting and deflecting means in the cartridge feed channel such that the cartridge supporting and deflecting means can be pivoted about a pivot axis which extends essentially parallel to the cartridge lengthwise axis. The cartridge supporting and deflecting means are pivotable under the action of the cartridges which are present in the cartridge feed channel, whenever one of the cartridges present in the cartridge feed channel bears upon the guide surface on the cartridge supporting and deflecting means.

The cartridge supporting and deflecting means further contain a bearing surface which faces the weapon housing and is arranged transverse relative to the guide surface of the supporting and deflecting means. A stationary stop is positioned in the cartridge feed channel in opposition to the cartridge supporting and deflecting means.

During operation of the inventive apparatus, the cartridge supporting and deflecting means are pivotable about the pivot axis under the action of a cartridge which passes from the cartridge feed channel to the cartridge chamber of the weapon barrel, from a first position in which the cartridge supporting and deflecting means do not engage the stationary stop, during movement of the cartridge past the cartridge supporting and deflecting means, into a second position in which the cartridge supporting and deflecting means engage the stationary stop and form, by means of the bearing surface of the cartridge supporting and deflecting means, a return stop which prohibits unintended retrograde motion of the cartridge tip.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
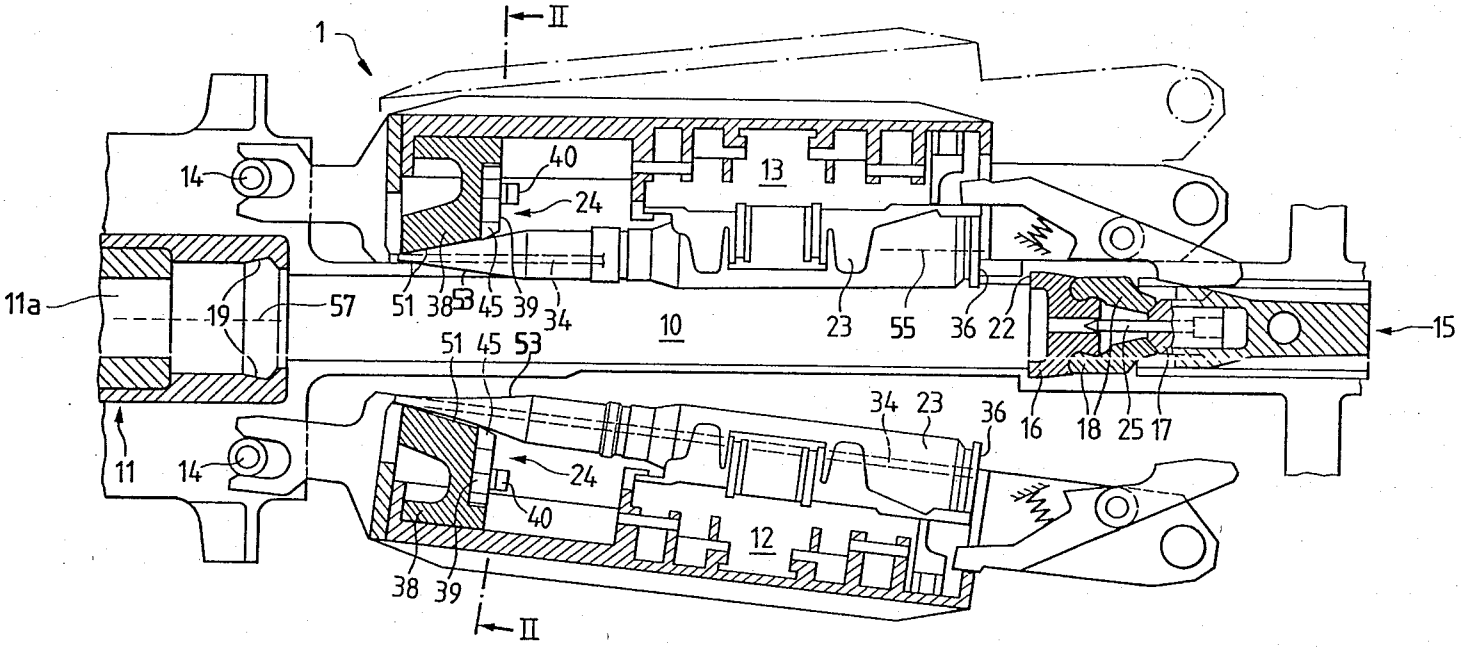
FIG. 1 schematically illustrates a longitudinal section through a portion of an automatic firing weapon containing an exemplary embodiment of the inventive cartridge insertion apparatus.

Describing now the drawings, it is to be understood that to simplify the showing thereof, only enough of the structure of the automatic firing weapon and its related apparatus for inserting a cartridge into cartridge chamber the of a weapon barrel has been illustrated therein as is needed to enable one skilled in the art to readily understand the underlying principles and concepts of this invention. Turning now specifically to FIG. 1 of the drawings, the apparatus illustrated therein by way of example and not limitation will be seen to comprise a weapon or gun housing 10 of an automatic firing weapon 1, upon the forward end of which a weapon barrel 11 having a cartridge chamber 11*a* is fastened. Two cartridge feed or supply channels 12 and 13 are pivotably mounted at the weapon housing 10 by means of two pivot pins 14 or equivalent structure. The left-hand cartridge feed channel 12 is represented in an outwardly pivoted position, so that no cartridges can be fed to the automatic firing weapon 1 from this channel 12. The right-hand cartridge feed channel 13 is, on the other hand, in its operative position, so that the cartridges 23 from this cartridge feed channel 13 can be inserted into the weapon barrel 11. The outwardly pivoted position of the cartridge feed channel 13 is indicated in phantom or chain-dot lines. Suitable conventional switching means, not particularly shown, ensure that one or the other of the cartridge feed channels 12 and 13 is always in the operative position while the other is pivoted out.

A reciprocating breechblock 15 is translatably mounted in the weapon housing 10. This breechblock 15 is shown in its rearmost position in FIG. 1 and has a breechblock head 16 and a control or actuating member 17 as well as two latches 18. The control or actuating member 17 is translatable within the breechblock head 16. In the foremost position of the breechblock 15, the control or actuating member 17 protrudes between the two latches 18 and forces the latches 18 into depressions or recesses 19 of the weapon barrel 11, so that the breechblock head 16 is latched in the weapon barrel 11. In the rearmost position of the breechblock 15, the control or actuating member 17 is situated behind the latches 18 and the breechblock head 16 is therefore unlatched. The translation of the breechblock 15 is effected in conventional manner in one direction by means of a not particularly shown forward advance recuperation spring and in the other direction by means of gas pressure. The transport of the cartridge belt in the cartridge feed channels 12 and 13 is also effected in conventional manner. Both operations are therefore not further described herein, particularly since the same do not constitute subject matter of the inventive development.

When the breechblock 15 is transferred from its rearmost to its foremost position, i.e. from the right to the left in FIG. 1, the breechblock 15 impinges with its edge 22 against the base or seat 36 of the cartridge 23. The cartridge lengthwise axis 55 is skew or inclined with respect to the weapon barrel axis 57. During further movement of the breechblock 15 the cartridge 23 is deflected towards the weapon barrel 11 by guide means 24 and inserted or rammed into the cartridge chamber 11*a* of the weapon barrel 11. Subsequently, the cartridge 23 is fired by a firing pin 25 of the control or actuating member 17. The guide means 24, which can best be seen in FIG. 2, constitute the predominant subject matter of the present invention.

Figure 2:
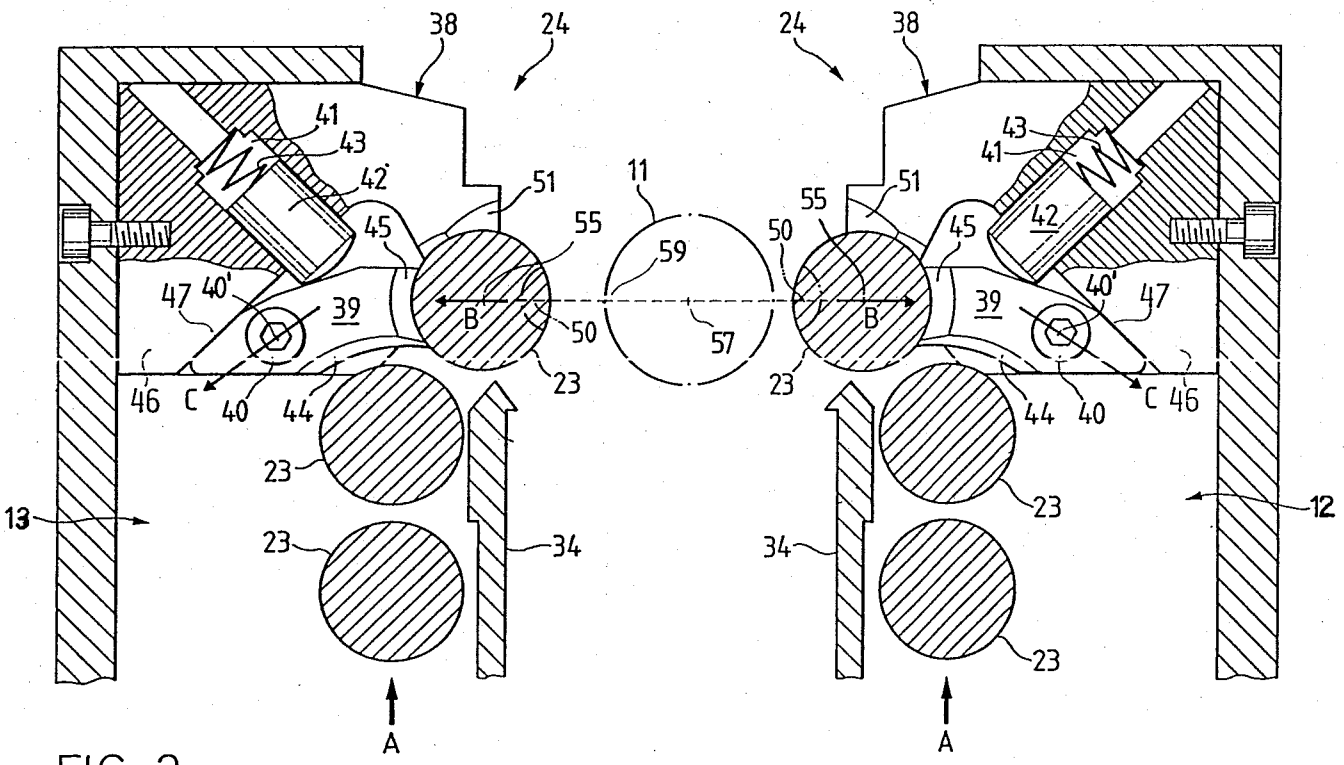
FIG. 2 shows a schematic cross-section along the line II—II in FIG. 1.

According to FIG. 2, the above-mentioned cartridge feed channels 12 and 13 each comprise a lateral wall 34. The cartridges 23 move in the cartridge feed channels 12 and 13 along these lateral walls 34 toward the weapon barrel 11 in the direction of the arrows A. The guide means 24 are arranged both on the right and left of the weapon barrel 11 and have the function of guiding or depressing the tips 53 of the associated cartridges 23 toward the weapon barrel 11, as can best be seen in FIG. 1.

These two guide means 24, which are constructed as mirror images of one another, each comprise a housing 38 in which cartridge supporting and deflecting or depressing means 39 in the form of a pawl are journaled to pivot about a pivot axis 40' defined by a shaft or bolt 40. A plunger 42 which contains a spring 43, is situated in a bore 41 in each housing 38. The spring 43 bears against the base of the plunger 42, on the one hand, and against the base of the bore 41, on the other hand, and tends to force the plunger 42 against the cartridge supporting and deflecting means or pawl 39 and thereby hold the cartridge supporting and deflecting means or pawl 39 in the position illustrated. The supporting and deflecting means or pawl 39 possesses a guide or deflecting surface 44 and a bearing or supporting surface 45. A stationary stop 46 is positioned in each one of the cartridge feed channels 12 and 13 opposite the associated cartridge supporting and deflecting means or pawl 39 and cooperates with a stop surface 47 which faces the weapon housing 10 and is located at the cartridge supporting and deflecting means or pawl 39.

The mode of operation of the apparatus described hereinbefore is as follows:

When the not particularly shown trigger of the automatic firing weapon 1 is operated, the breechblock 15 is released and displaced to the left as seen in FIG. 1 under the action of the force of the likewise not particularly shown but conventional forward advance or recuperation spring. The breechblock 15 thus travels forwardly toward the weapon barrel 11 and impinges with its edge 22 against a cartridge 23 in the cartridge feed channel which is in its operative position, in the illustrated embodiment the right-hand cartridge feed channel 12. The cartridge 23 is thereby inserted or rammed into the cartridge chamber 11*a* of the weapon barrel 11 and fired in conventional manner by means of the firing pin 25.

The guide means 24 ensure that the cartridge tip 53 does not lodge or abut anywhere upon being inserted into the weapon barrel 11, but is precisely inserted or rammed into the cartridge chamber 11*a* of the weapon barrel 11.

During such insertion or ramming operation, and as stated above, the guide means 24 insure that the cartridge 23 does not abut against any location during the insertion of the cartridge 23 into the cartridge chamber 11*a* of the weapon barrel 11. As illustrated in FIG. 1, the edge 22 of the breechblock 15 impinges against the base or seat 36 of the cartridge 23 during the insertion of the cartridge 23 into the cartridge chamber 11*a* of the weapon barrel 11. Such engagement or contact surface at the bottom or seat 36 of the cartridge 23 is indicated in FIG. 2 and designated by the reference character 50. It is clearly evident from FIG. 1 as well as from FIG. 2 that such engagement or contact surface 50 is eccentrically located. At high cadences or firing rates of the automatic firing weapon 1 the breechblock 15 thus eccentrically impinges against the base or seat 36 of the cartridge 23 at high velocity in the manner as described hereinbefore. Such eccentric impingement generates a force directed in the direction of the arrow B which is shown in FIG. 2. Due to such force, the cartridge 23 is thrust against the surface 51 of the housing 38, particularly in the case that the breechblock 15 including the breechblock head 16 has arrived in the region of the guide means 24. Additionally, the cartridge 23 is thrust against the bearing or supporting surface 45 of the cartridge supporting and deflecting means or pawl 39.

According to FIGS. 1 and 2 the surface 51 at the housing 38 and the bearing or supporting surface 45 at the cartridge supporting and deflecting means or pawl 39 are disposed at different inclinations. Therefore, the cartridge 23 will exert a force directed in the direction of the arrow C in FIG. 2 upon the cartridge supporting and deflecting means or pawl 39. This force C extends through the pivot axis 40' of the cartridge supporting and deflecting means or pawl 39. It is thereby insured that during insertion of the cartridge 23 into the weapon barrel 11, the cartridge supporting and deflecting means or pawl 39 is not deflected or outwardly pushed in unintentional manner. This is particularly significant since the force of the spring 43, which acts upon the plunger 42 and thereby holds the stop surface 47 of the cartridge supporting and deflecting means or pawl 39 engaged to the stationary stop 46, would be much too low for preventing outward deflection of the cartridge supporting and deflecting means or pawl 39 under the action of the force B at the time the breechblock 15 impinges and acts upon the base or seat 36 of the cartridge 23.

As soon as the cartridge 23 has been inserted into the weapon barrel 11, the cartridges 23 which are present in the left-hand cartridge feed channel 13, see FIG. 2, are upwardly displaced in the direction of the arrow A by the not particularly shown conventional cartridge feed mechanism. The cartridge 23 which engages the guide or deflecting surface 44 of the cartridge supporting and deflecting means or pawl 39, presses upon such cartridge supporting and deflecting means or pawl 39 which, as a result, is pivoted in clockwise direction and thereby displaces the plunger 42 against the force of the spring 43. As a result, the cartridge supporting and deflecting means or pawl 39 assumes a first position in which its stop surface 47 is disengaged from the stationary stop 46 in the cartridge feed channel 13. In this first position of the cartridge supporting and deflecting means or pawl 39 the cartridge tip 53 is permitted to pass the guide or deflecting surface 44 whereafter the cartridge supporting and deflecting means or pawl 39 is returned into the initial or second position under the action of the spring-loaded plunger 42. In the initial or second position the stop surface 47 is re-engaged at the stationary stop 46 in the cartridge feed channel 13 and the cartridge tip 53 is engaged at the bearing or supporting surface 45 of the cartridge supporting and deflecting means or pawl 39. As a result, the cartridge supporting and deflecting means or pawl 39 forms, by means of its bearing or supporting surface 45, a return stop which prohibits unintended retrograde motion or displacement of the cartridge tip 53 back into the cartridge feed channel 13.

During the further insertion or ramming action of the breechblock 15 upon the base or seat 36 of the cartridge 23, as illustrated in FIG. 2, the cartridge supporting and deflecting means or pawl 39 remains in its aforementioned second position in which the stop surface 46 engages the stationary stop 47 in the cartridge feed channel 13. During such further insertion or ramming operation of the breechblock 15 upon the cartridge 23, the cartridge supporting and deflecting means or pawl 39 remains in this second position and, as a result, the pivot axis 40' of the cartridge supporting and deflecting means or pawl 39, the cartridge lengthwise axis 55 and the weapon barrel axis 57 approximately extend in a common plane 59. This has the further consequence that any retrograde force B tending to subject the cartridge 23 to an unintended retrograde motion or displacement back into the cartridge feed channel 13, is counteracted because by the bearing or supporting surface 45. The thus produced aforementioned resultant force C extends in a direction through the pivot axis 40' of the cartridge supporting and deflecting means or pawl 39. Any displacement of the cartridge supporting and deflecting means or pawl 39 under the action of the resultant force C is thus positively blocked due to the engagement of the stop surface 47 of the cartridge supporting and deflecting means or pawl 39 at the cooperating stationary stop 46 in the cartridge feed channel 13.

While there are shown and described present preferred embodiments of the invention, it is to be distinctly understood that the invention is not limited thereto, but may be otherwise variously embodied and practiced within the scope of the following claims.

Accordingly, what I claim is:

1. An apparatus for inserting cartridges each having a cartridge tip and a cartridge lengthwise axis, into a cartridge chamber of a weapon barrel in an automatic firing weapon having a weapon housing, comprising:

a cartridge feed channel arranged adjacent to said weapon barrel;

a breechblock reciprocating within the weapon housing of said automatic firing weapon for inserting cartridges from said cartridge feed channel into said cartridge chamber of said weapon barrel;

guide means for deflecting cartridges present in said cartridge feed channel towards said weapon barrel;

said guide means containing cartridge supporting and deflecting means protruding into said cartridge feed channel in the region of the cartridge tips of the cartridges and acting upon said cartridge tips at the start of insertion of the cartridges into the cartridge chamber;

said cartridge supporting and deflecting means containing a guide surface facing said cartridges arranged in said cartridge feed channel;

means for pivotably mounting said cartridge supporting and deflecting means in said cartridge feed channel for pivoting about a pivot axis which extends essentially parallel to the cartridge lengthwise axis, said cartridge supporting and deflecting means being pivotable under the action of the cartridges present in said cartridge feed channel whenever one of said cartridges present in said cartridge feed channel bears upon said guide surface of said cartridge supporting and deflecting means;

said cartridge supporting and deflecting means further containing a bearing surface facing said weapon housing and arranged transverse relative to said guide surface of said cartridge supporting and deflecting means;

a stationary stop positioned in said cartridge feed channel in opposition to said cartridge supporting and deflecting means; and said cartridge supporting and deflecting means, after being pivoted about said pivot axis under the action of a cartridge incoming from said cartridge feed channel into a first position in which said cartridge supporting and deflecting means do not engage said stationary stop, being pivotable during further movement of said cartridge past said cartridge supporting and deflecting means, into a second position in which said cartridge supporting and deflecting means engage said stationary stop and forms, by means of said bearing surface of said cartridge supporting and deflecting means, a return stop which prohibits unintended retrograde motion of the cartridge tip.

2. The apparatus as defined in claim 1, wherein:

said cartridge supporting and deflecting means constitute a cartridge supporting and deflecting pawl.

3. The apparatus as defined in claim 1, wherein:

said weapon barrel defines a weapon barrel axis;

said pivot axis about which said cartridge supporting and deflecting means are pivotable, and said weapon barrel axis approximately extending in a common plane; and said lengthwise axis of each said cartridge, during insertion of the cartridge into said cartridge chamber of said weapon barrel under the action of said breechblock, being approximately arranged in said common plane whereby said cartridge supporting and deflecting means are positively prevented from being pivoted out of position under the action of the force exerted upon the cartridge by the breechblock.

* * * * *

UNITED STATES PATENT AND TRADEMARK OFFICE

CERTIFICATE OF CORRECTION

PATENT NO. : 4,688,467

DATED : August 25, 1987

INVENTOR(S) : WERNER STAUFFACHER

It is certified that error appears in the above-identified patent and that said Letters Patent is hereby corrected as shown below:

Column 3, line 39, after "into" please insert --the--

Column 3, line 40, before "of" please delete "the"

Column 6, line 47, please delete "because"

Signed and Sealed this

Nineteenth Day of April, 1988

*Attest:*

*Attesting Officer*

DONALD J. QUIGG

*Commissioner of Patents and Trademarks*